United States Patent [19]

Searle et al.

[11] 3,933,232

[45] Jan. 20, 1976

[54] COIN VALIDATOR

[75] Inventors: Brian Christopher Searle, Staines, England; Glenn Richard Ritter, West Allenhurst, N.J.

[73] Assignee: Tiltman Langley Ltd., England

[22] Filed: June 17, 1974

[21] Appl. No.: 480,256

[52] U.S. Cl. ..... 194/100 A; 328/147

[51] Int. Cl.[2] ..... G07F 3/02

[58] Field of Search ..... 194/100 R, 100 A, 101; 328/146, 147, 116; 307/235; 209/81 R, 81 A, 111.9; 73/67.2

[56] References Cited

UNITED STATES PATENTS

| | | | |
|---|---|---|---|
| 3,373,856 | 3/1968 | Kusters et al. | 194/100 R |
| 3,599,096 | 8/1971 | Stemples et al. | 328/147 |
| 3,599,771 | 8/1971 | Hinterstocket | 194/100 A |
| 3,682,286 | 8/1972 | Prumm | 194/100 A |
| 3,797,307 | 3/1974 | Johnston | 194/100 A |

*Primary Examiner*—Robert B. Reeves
*Assistant Examiner*—H. Grant Skaggs
*Attorney, Agent, or Firm*—Shapiro and Shapiro

[57] ABSTRACT

The invention relates to a single chute, multidenomination, coin validator using a transformer to generate a transient signal whose amplitude varies with the denomination of the coin sensed by the transformer. The signal may operate more than one of a plurality of "window" type comparators corresponding respectively to the valid denominations but, if so, it causes sequential operation thereof. A control signal is generated at the peak of the signal amplitude and the criterion of validity is the coincidence of the control signal and a comparator output signal. A coin gate may be used to prevent valid coins being retrieved from the coin chute.

16 Claims, 4 Drawing Figures

COIN VALIDATOR

The present invention relates to a coin validator for use with vending or dispensing machines or with turnstile mechanisms, particularly those associated with ticket dispensing machines.

Mechanical coin validators are well known and are in common use with vending or dispensing machines and with turnstiles. The mechanical validators, however, are not suitable for very intensive use because of their slowness. For instance, they are not suitable for use with a ticket dispenser at a railway station or on a bus during the "rush" period.

It is an object of the present invention to provide a compact electronic coin validator.

It is a further object to provide a circuit for such a validator reducing to the minimum the use of heat-producing devices such as photo-cell arrangements the lamps of which in a very confined space may raise the temperature to unacceptable levels.

It is a still further object to provide an electronic coin validator using a single chute for coins of a plurality of denominations.

It is also an object to provide an electronic coin validator circuit in which coins of the different denominations produce distinctive signals and in which pre-set parameters are set up representing within precise predetermined limits the signals corresponding to those of the valid coin denominations.

It is a further object to provide such electronic coin validator circuit in which only a comparison between a coin signal and pre-set parameter coincident with a control signal generated at a predetermined time during the coin signal, is taken as validating a coin.

It is a still further object to provide an electronic coin validator circuit in which provision is made for controlling a gate to make it impossible for a validated coin to be recovered by the user from the coin chute.

It is also an object of the invention to provide an electronic coin validator of a more efficacious general use.

Figure 1:
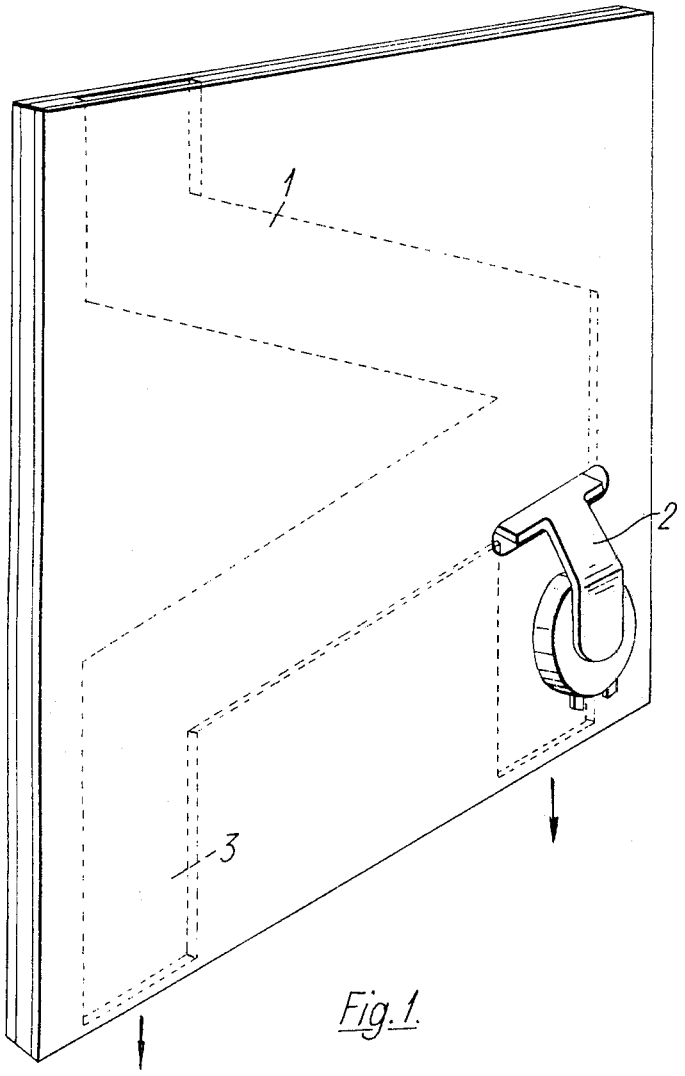
Figure 2A:
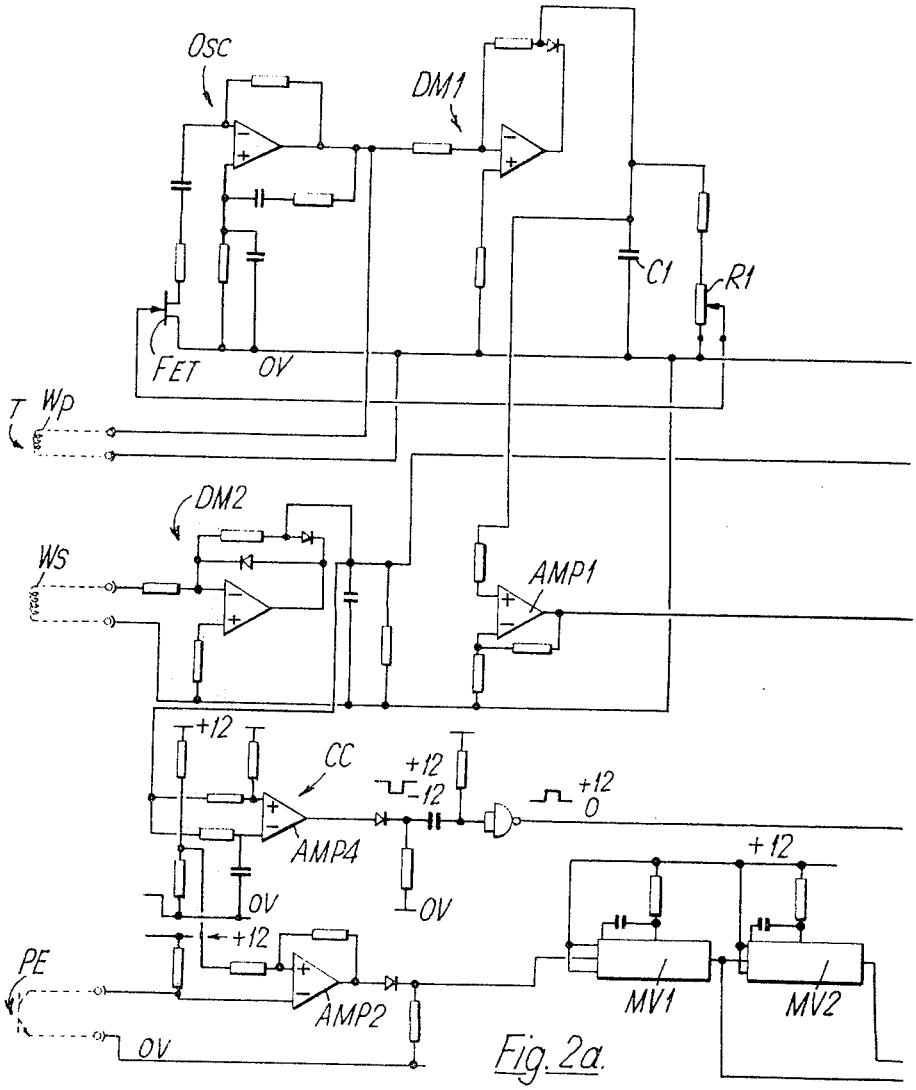
Figure 2B:
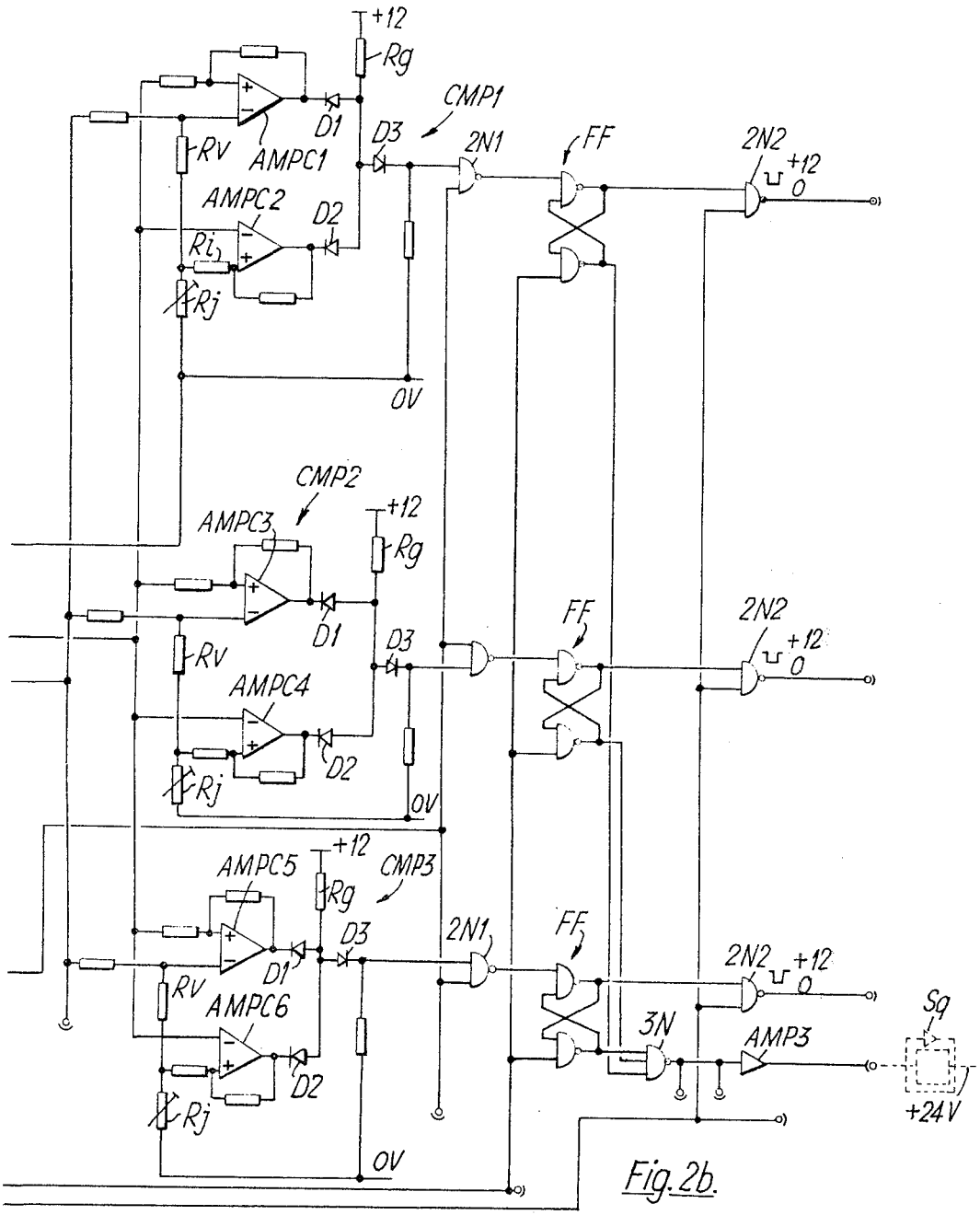
Figure 3:
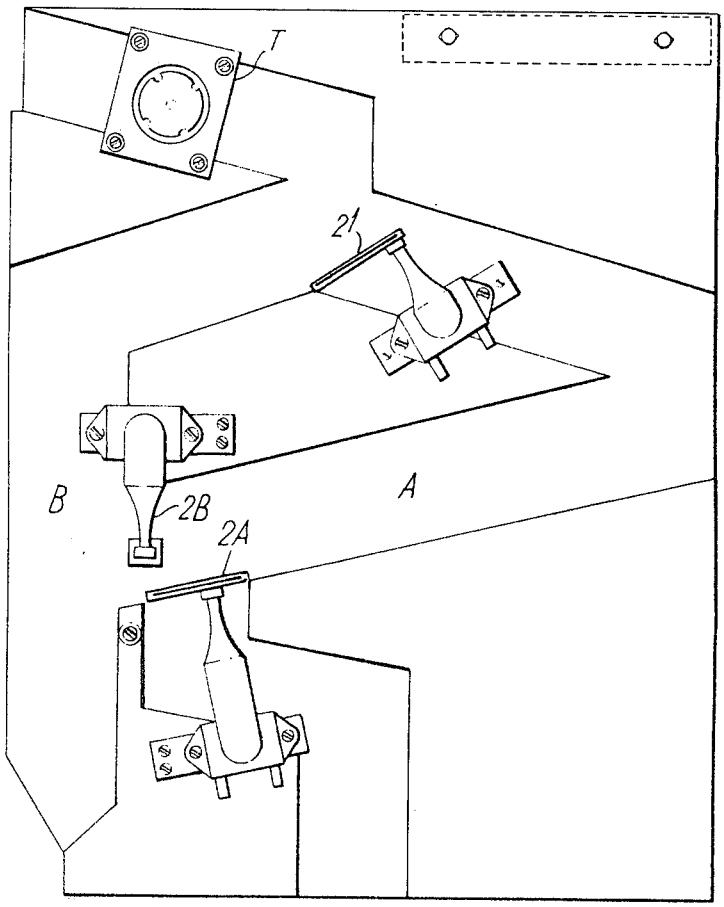

A preferred embodiment of a coin validator of the invention will now be described with reference to the accompanying drawings in which:

FIG. 1 is a perspective view of a coin chute for use in the embodiment;

FIG. 2*a* and 2*b* is a circuit diagram of the circuit employed in the embodiment; and FIG. 3 is a side view of an alternative coin chute for use in the embodiment.

The circuit of the embodiment is for use with coin-actuated apparatus comprising the coin chute 1 (FIG. 1) into which the user of the apparatus inserts the necessary coin or coins, and is adapted to validate any one of three denominations of coin, for instance, the nickel (5 cents), dime (10 cents) and quarter (25 cents)-denominations of U.S. currency. The apparatus also comprises a coin gate 2 which, on validation of a coin, opens to permit the coin to fall to the coin vault (not shown) of the apparatus, or which, in the event that the coin is not validated, remains closed to cause the coin to pass on to a rejection channel 3 for return to the user.

The circuit comprises a coin sensing transformer the windings of which are located in or by the coin chute so that as the coin, in passing down the chute, passes the transformer windings, it reduces the transfer of energy between the primary and the secondary of the windings.

From this transient disturbance of the transformer operation, the circuit generates a signal in the form of a continuous voltage curve passing between two voltage levels. In the present embodiment as described below, the circuit is arranged so that the signal rises in the positive direction of voltage and falls in the negative direction and, therefore, comprises a peak, but it will be understood that a signal providing a trough could just as readily be used. The effect of the coin on the transformer operation varies, for any given transformer, with the size and composition of the coin, with the result that the coins of the different denominations such as nickel, dime and quarter give rise to signals of different amplitude. In connection with the coins mentioned of the U.S. currency, it may be assumed that, in the circuit as described below, the amplitude of the signal increases with the value of the denomination, but again it will be understood that the circuit could readily be arranged so that the amplitude of the signal decreases with an increase in the value of the denomination.

The circuit generally comprises the transformer, an oscillator the output of which is fed to the primary of the transformer, an arrangement for demodulating and amplifying the output of the oscillator to provide a first steady reference voltage, an arrangement for demodulating and amplifying the output of the secondary of the transformer to provide, in the no signal condition of the secondary, a second steady reference voltage representing that condition, a series of three "window" type comparators in which the demodulated voltages are compared, there being one comparator for each denomination of coin to be validated; and output logic circuity and control circuitry.

The circuit of the embodiment is intended to operate, when a coin is sensed, to compare the signal produced with different amplitude parameters respectively set up electrically in the comparators; the three parameters corresponding to the signal amplitudes produced by coins of the respective denominations. If the amplitude parameter of any of the comparators is equal to or less than that of any signal produced, the comparator is operated to produce an output signal. However, each comparator operates only by a switching action from an "off" condition to an "on" condition and then back to the "off" condition to produce a discrete output signal. Thus, although more than one comparator may be operated by a signal derived from sensing a coin, because of the nature of the signal causing such operation, the comparators concerned would produce their output signals at different times viz: the greater the amplitude of the coin sensing signal, the earlier in time before the peak of any signal, will any comparator, set up for a lesser amplitude of signal, operate. On sensing a coin, the circuit also generates, to coincide with the peak of signal produced thereby, a control signal by which only the comparator output signal produced simultaneously with the control signal is taken as indicating a valid coin. It will be seen, therefore, that only the output signal of the comparator which is itself operated by the peak of the signal derived from sensing a coin, is taken as indicating that the coin sensed is one of a valid denomination. Since coins used in a coin slot machine may be worn or damaged and thus give rise to some variation in the signal derived from sensing the coins, each comparator is arranged so that it is switched between two slightly different voltage levels; the levels being chosen, by prior trial and error, to provide maximum validation of valid coins and maximum rejection of invalid coins.

When a coin is validated, the coin gate is operated to permit the coin to fall to the coin vault. A photo cell is stationed at the gate so that as the coin goes through a signal is provided to permit an output to be taken from the circuit corresponding to the value of the coin. This arrangement prevents valid coins being retrieved from the coin slot after the output signal has been taken from the circuit i.e. to operate the vending or dispensing machine the coin validator is used with. Otherwise, the machine could be operated repeatedly with the same coin by retrieval of it each time from the coin slot, for instance, by attaching the coin to a length of thread or string.

To permit the comparators to operate between a lower and a higher level of signal amplitude, each comparator comprises a pair of differential amplifiers with one of them set to switch on when any signal applied to it exceeds the lower limit and with the other of them set to switch off if the applied signal amplitude exceeds the higher limit. The output stage of each comparator comprises an AND gate so that as the one amplifier switches on one of the input signals is applied to the gate by the amplifier. Since the other amplifier is "on", the other input to the gate is already present and thus the comparator produces an output. If the peak of the signal occurs between the limits set by the comparator, then following operation of the one amplifier, the signal will decay and switch that amplifier back to the "off" condition, thus removing one of the inputs to the AND gate. If, however, the peak of the signal lies beyond the upper limit of the comparator, the other of the amplifiers will be switched to the "off" condition and again remove one of the inputs from the AND gate. In either instance, therefore, the comparator ceases to produce an output at substantially the same instant in time.

Turning now to the circuit diagram, the oscillator O*sc* is a Weinbridge type oscillator the output of which is applied to the primary W*p* of the transformer T. The output is also applied to a positive half cycle demodulator DM1 whose output is smoothed by capacitor C1. Supplementary stabilization for the oscillator, particularly in respect of temperature, is provided by a feedback from the demodulator output through adjustable resistor R1 to the base of the field effect transistor FET contained in one arm of the bridge. The demodulator output is amplified in differential amplifier AMP1 to provide a first steady, positive, reference voltage for each of the three comparators generally indicated at C*mp*1, 2 and 3 respectively. The output of the secondary W*s* of the transformer is amplified and demodulated by negative, half cycle demodulator arrangement DM2 to provide a second steady but negative, reference voltage for the comparators representing the no signal condition.

The respective pairs of differential amplifiers of the comparators are indicated by AMPC1, 2; AMPC3, 4 and AMPC5, 6 respectively. Amplifiers AMPC1, 3 and 5 receive respectively at their positive and negative input terminals the negative and positive reference voltages through respective resistors as shown in the diagram, while amplifiers AMPC2, 4 and 6 receive respectively at their negative and positive input terminals, the negative reference voltage directly and through a respective resistor R*v* of voltage divider and a further resistor R*i* the positive reference voltage. Resistor R*v* determines the range of amplitude between the limits at which the comparator will operate while an adjustable resistor R*j* of the voltage divider determines the voltage level of the lower one of the limits. The AND gate of each comparator output is constituted by three diodes D1, D2, and D3 the anodes of which are connected in common to a positive voltage source through a resistor R*g*. Each AND gate output is connected to one of the inputs of a 2-NAND gate 2N1 the other input of which is connected to a control circuit CC as hereinafter described; and each NAND gate controls a flip-flop FF one output of which in turn is connected to one of the inputs of a further 2-NAND gate 2N2. The further 2-NAND gates serve as the circuit output devices from which, when actuated, an output signal representing one of the coin denominations is taken for use in operating the vending or dispensing machines the coin validator is used with. The other input of each NAND gate 2N2 is taken from the output of a monostable multi-vibrator MV1 fed from a differential amplifier AMP2 the input to which is connected to the photo cell, indicated at PE, stationed at the coin gate. The device MV1 also provides an output to a further monostable multi-vibrator MV2 connected to the re-set input of each flip flop. The other output of each of the flip flops is connected to a 3-NAND gate 3N controlling, via an amplifier AMP3, operation of a solenoid S*g* by which the coin gate 3 is operated.

The control circuit CC mentioned above comprises a differential amplifier AMP4 connected to the demodulator arrangement but set up to respond only to the peak of any signal resulting from the sensing of a coin to produce a control pulse which is applied to said other input of each of the NAND gates 2N1.

In operation of the circuit, the sensing of a coin by the transformer imposes a signal, as above described, on the second reference voltage. This has the effect of switching on one of the comparators (which would be the one for the nickel denomination) or that and one or both of the other comparators sequentially. When the signal reaches its peak, the control circuit CC produces a control pulse: if the coin concerned is a valid one, then one of the comparators will be operated substantially at the peak of the signal and accordingly, the NAND gate 2N1 thereof will set the flip-flop to provide a signal at the one input of the respective output device and a signal at one of the inputs of the 3-NAND gate 3N. The gate, in this instance, serves an OR function and consequentially produces a signal which, after amplification in amplifier AMP2, operates the coin gate. The coin will, therefore, pass through the gate and cause the photo cell to actuate amplifier AMP3 to provide a signal via device MV1 at the other input of each of the output devices. Meanwhile, the flip flop which has been operated will have maintained a signal at the one input of the respective one of the output devices which will thus provide an output signal representing the denomination of the validated coin. If the coin was not one of a valid denomination, it would have produced a signal whose peak would be between the "windows" of the comparators and, therefore, would not produce a control signal simultaneously with the operation of any comparator that had been operated. Therefore, no flip-flop would have been operated simultaneously with the production of the control signal, and no signal would have been provided at the 3-NAND.

The device MV1 produces a rectangular pulse the trailing end of which causes operation of the multivibrator MV2 and the pulse from this device is applied to all the flip flops to re-set the one of them operated in response to the validated coin.

The flip flops may be replaced by shift registers in order to permit rapid insertion of a plurality of coins for instance, when the chute is arranged as a vertical channel and the coins are dropped in virtually touching one another.

The coin chute of FIG. 1 may also be replaced by any suitable coin chute but, in particular, by the one shown in FIG. 3 which incorporates an escrow facility. The transformer is shown at T and the gate corresponding to gate 2 of FIG. 3 is shown at 2'. The coin channel as in FIG. 1 is branched to provide a reject channel B and a validation channel A. However, the channel A gives access again to the reject channel B at the location of a release gate 2B and, just before this junction, is guarded by a further, summation, gate 2A. The arrangement is such that valid coins may be held between gates 2' and 2A until a given sum has been built up when gate 2A may be operated to deliver the coins to the coin vault and operate the machine. However, if the user prefers (for instance if he finds he has insufficient coins) he may open the release gate 2B to recover his coins.

I claim:

1. A coin validator electronic circuit comprising:

coin sensing means for producing a transient signal the amplitude of which is dependent on the denomination of the coin sensed;

a plurality of comparator means set up with amplitude parameters respectively to represent the coin denomination to be validated and each operable by a signal whose amplitude is at least equal to the amplitude parameter of the comparator means, but so that operation of more than one comparator means by any one signal is sequential;

means for generating a control signal at the maximum of the transient signal amplitude;

and means responsive to a control signal generated by said generating means and to the operation of a comparator means, only when the coin sensed by the coin sensing means gives rise to said control signal and to said operation of the comparator means coincidently in time, to produce a circuit output signal indicating validation of that coin.

2. A circuit according to claim 1, wherein the coin sensing means comprises a transformer the energy transfer between the windings of which is disturbed by the passage of a coin in proximity thereto.

3. A circuit according to claim 2, wherein the coin sensing means further comprises an oscillator to supply the transformer, and a demodulation arrangement responsive to the voltage developed in the secondary of the transformer to provide, in the no signal condition of the transformer, a steady voltage, and to impose on the steady voltage, when a coin is sensed, the signal resulting therefrom; the comparator means each being connected to receive said steady voltage and any signal imposed thereon.

4. A circuit according to claim 3, wherein the oscillator is a Weinbridge type oscillator.

5. A circuit according to claim 1, wherein each comparator means is arranged to produce an output in response to a range of signal amplitude.

6. A circuit according to claim 5, wherein each comparator means comprises a pair of differential amplifiers one of which is set up to respond to a signal amplitude at least equal to the lower limit of the amplitude range to cause the comparator means to produce an output, and the other of which is set up to respond to a signal amplitude at least equal to the upper limit of the amplitude range to cause the comparator means output to cease, whereby each comparator means produces a discrete output signal in response to any signal causing operation of the comparator means.

7. A circuit according to claim 6, wherein the coin sensing means comprises means to produce a first and second steady voltage of opposite polarity in the no signal condition of the sensing means and to impose on said second steady voltage, when a coin is sensed, the signal resulting there from; and wherein each comparator means comprises an output stage constituted by an AND gate, and the pair of amplifiers of each comparator means receive the two steady voltages so that, in response thereto, said one of the pair is maintained in the off condition to deprive the AND gate of one input while said other of the pair is maintained in the on condition in which it supplies the other of the imputs to the AND gate, and so that in response to said signal, in the case where the amplitude thereof is within the range set by the pair of amplifiers, said one amplifier is switched on as the signal amplitude rises above the lower limit of the range to cause the comparator means to produce an output and is then switched off again as the signal amplitude subsequently decays below said lower limit of the range and, in the case where the signal amplitude is greater than the upper limit of the amplitude range, first said one amplifier is switched on to cause the comparator means to produce an output as the signal amplitude rises above the lower limit of the amplitude, and then said other amplifier is switched off as the signal amplitude rises above the upper limit of the amplitude range to cause the comparator means to cease producing an output.

8. A circuit according to claim 7, wherein the coin sensing means comprises:

a transformer the energy transfer between the windings of which is disturbed by the passage of a coin in proximity thereto;

an oscillator to supply the transformer;

a first demodulation means to demodulate the oscillator signal to provide said first steady voltage;

a second demodulation means responsive to the voltage developed in the secondary of the transformer to provide, in the no signal condition of the transformer, said second steady voltage, and to impose on said second steady voltage, when a coin is sensed, the signal resulting therefrom.

9. A circuit according to claim 1, comprising means for operating a coin gate; said means acting to prevent a circuit output signal from being produced until the gate has been operated, and being responsive to the coincidence of said control signal and a comparator means output to operate the gate.

10. A circuit according to claim 9, comprising a photoelectric cell to be stationed at the gate to provide a pass signal on the passage of a coin past the gate, to permit a circuit output signal to be produced.

11. A circuit according to claim 10, wherein each comparator means is associated with a logic gate serving an AND function one input of which is provided on operation of the comparator means and the other input of which is provided by said control signal; and wherein means are provided, in respect of each of the logic gates, for storing any output of the logic gate until said pass signal is produced.

12. A circuit according to claim 11, wherein the output of the storage device is connected to one input of a logic gate serving an AND function; the other input of the logic gate being connected to receive said pass signal.

13. A circuit according to claim 11, wherein the output of each storage means is also connected to a three input logic gate serving an OR function; said gate operating means being responsive to the output of the gate.

14. A circuit according to claim 11, wherein said storage means is a flip flop.

15. A circuit according to claim 14 wherein means are provided, responsive to the termination of said pass signal, for resetting any flip flop from which a signal has been read out in response to the pass signal.

16. A coin validator electronic circuit comprising:

a transformer the energy transfer between the windings of which is disturbed by the passage of a coin in proximity thereto;

an oscillator to supply the transformer, a first demodulation means for demodulating the oscillator output to provide a first steady voltage;

a second demodulation means to demodulate the voltage of the secondary of the transformer to produce, in the no signal condition of the transformer, a second steady voltage and to impose thereon in response to the sensing of a coin by the transformer, a transient signal the amplitude of which is dependent on the denomination of the coin sensed;

a plurality of comparators, one for each coin denomination to be validated, each comprising a pair of differential amplifiers together with an output AND gate and receiving the first and second steady reference voltage so that normally one amplifier of a pair is switched off and the other amplifier of a pair is switched on, and so that in response to the imposition of a signal on said second voltage, when the signal amplitude reaches a first limit, the one amplifier is switched on to complete the second input to the AND gate, and when the signal amplitude reaches a second limit the other amplifier is switched off to remove an input from the AND gate so that in the event that more than one comparator is operated by said signal, the comparators are operated sequentially;

means for producing a control signal at the maximum of the signal amplitude;

a logic gate for each comparator serving an AND function to receive as one input any output of the comparator and as the other input, the control signal;

a flip-flop, one for each comparator, receiving the output of the logic gate;

a logic gate, serving an OR function, to receive the outputs of the flip flops;

means responsive to the output of the logic gate for operating a coin gate, means including a photo-cell for providing a pass signal on the passage of a coin past the coin gate;

a further logic gate for each flip-flop serving an AND function and receiving as one input, any output of the flip flop and as the second input, the pass signal to provide a circuit output signal on operation of the gate; and means operated by the pass signal for re-setting any flip flop from which a signal has been read out in response to said pass signal.

* * * * *